US005129121A

United States Patent [19]

Gelman

[11] Patent Number: 5,129,121

[45] Date of Patent: Jul. 14, 1992

[54] TURBINE DRIVEN ROTATING BRUSH

[76] Inventor: Gideon Gelman, 211 E. Ohio, Apt. 1201, Chicago, Ill. 60611

[21] Appl. No.: 408,878

[22] Filed: Sep. 18, 1989

[51] Int. Cl.[5] ..... A46B 13/06

[52] U.S. Cl. ..... 15/29

[58] Field of Search ..... 15/24, 29, 97.1

[56] References Cited

U.S. PATENT DOCUMENTS

| | | | |
|---|---|---|---|
| 2,545,110 | 3/1951 | Schaar et al. . | |
| 2,905,394 | 9/1959 | Swan . | |
| 2,968,442 | 1/1961 | Grabski . | |
| 3,120,346 | 2/1964 | Willhoite . | |
| 3,473,736 | 10/1969 | Heitzman . | |
| 3,944,140 | 3/1976 | Caton et al. . | |
| 3,967,783 | 7/1976 | Halsted et al. . | |
| 4,010,899 | 3/1977 | Heitzman . | |
| 4,084,281 | 4/1978 | Smith | 15/29 |
| 4,282,623 | 8/1981 | Gacuzana | 15/29 |
| 4,303,201 | 12/1981 | Elkins et al. . | |
| 4,327,454 | 5/1982 | Spence | 15/29 |
| 4,513,466 | 4/1985 | Keddie et al. | 15/29 |

FOREIGN PATENT DOCUMENTS

| | | | |
|---|---|---|---|
| 3113645 | 10/1982 | Fed. Rep. of Germany | 15/29 |
| 618563 | 3/1961 | Italy | 15/29 |
| 361489 | 5/1962 | Switzerland | 15/29 |
| 436216 | 11/1967 | Switzerland | 15/29 |

OTHER PUBLICATIONS

EpiSsage Advertising brochure 1989.

Advertisement for EpiSsage in Chicago Sun Times, Jun. 21, 1989.

*Primary Examiner*—Edward L. Roberts

*Attorney, Agent, or Firm*—Arnold, White & Durkee

[57] ABSTRACT

A turbine driven rotating brush includes a turbine enclosed in a housing having an inlet for receiving water and an outlet for discharging water flow. A port in the housing directs water onto blades of the turbine. A reduction gear transmits the torque output of the turbine to a shaft on which the brush is mounted. The turbine may be located adjacent a backstop so that water exiting the housing through the outlet is incident on the backstop. The backstop breaks up the discharge of the flow of water outwardly away from the brush for achieving different spray patterns around the brush.

10 Claims, 5 Drawing Sheets 79
80
81
74
23
46
75

33
50
49
53
54
42
55
35
36
32
21
31
27
26
25
30
40
46
48
24
47
53
46
49
36
49
55
44
62
22

49
55
45
44
65
66
64
70
71
73
72

42
43

74
52
51
49

TURBINE DRIVEN ROTATING BRUSH

BACKGROUND OF THE INVENTION

1. Field of the Invention

The present invention relates to rotary brushes for washing and scrubbing in conjunction with the use of detergent and the like. More particularly, the present invention relates to a combined shower head having a turbine driven rotating brush adapted for connection to a source of water such as a shower. The improved device of the present invention contains a reduction gear system that increases torque to the rotating brush.

2. Description of Prior Art

A variety of rotary washing and scrubbing devices of this general type have been developed in which a flow of water is directed through openings in a brush or scrubber to provide a steady or pulsating spray. For example, a shower head with a rotational shaft with impeller blades mounted on one end and a rotary brush engaging a detergent bar on the other end is shown in U.S. Pat. No. 3,944,140 to Caton et al. The rotation is utilized to generate soap and not to rotate a brush to scrub a body.

Typically, such prior art devices are constructed with a brush on one end and a water flow inlet on the other, with the water flow outlet providing water for the brush. The brush is rotated by the power of the water stream turning a turbine as the water flows around the brush during use.

Such prior art devices which have utilized water flow through the turbine to rotate the brush have many inadequacies. The water flow through these devices, alone, does not provide a large enough torque about the rotating brush to allow continuous rotation of the brush during use. A large amount of torque is required when the brush is pushed against an object during cleaning. This is especially true if the brush is formed with hard bristles. The stream of water generally cannot provide an adequate amount of torque to rotate the brush during contact with the scrubbed object. The attainment of additional scrubbing power with a rotating brush is lost when the frictional force between the bristles and the scrubbed object provides a resisting torque greater than the torque provided by the water flow to the brush. Of course under such circumstances the movement of the brush is prevented.

As a result of the diversity of uses of rotating brushes, there is a need for a rotating brush which provides enough torque to overcome the frictional resistance. Further, it is desirable that the torque be provided from the incoming water stream, without the need for complex or hazardous electrical connections.

OBJECTS OF THE INVENTION

Accordingly it is an object of this invention to provide an improved turbine driven rotating brush for connection to a water source, and particularly to provide a brush which meets the aforementioned needs.

It is a specific object of this invention to provide a turbine driven brush which provides a greater torque to the brush in order to allow continuous rotation of the brush during use.

It is another object of this invention to provide a brush that avoids the disadvantages and complexities of the prior art.

It is a further object of this invention to provide a brush that outlets the water Other objects, advantages and features of this invention will become apparent on reading the following description and appended claims, and upon reference to the accompanying drawings.

SUMMARY OF THE INVENTION

In accordance with one embodiment of this invention, a turbine driven rotating brush which achieves the foregoing objects includes a turbine enclosed in a housing having an inlet for receiving water and an outlet for discharging water flow and a port for directing water onto the blades of the turbine. A connection means transmits the torque output of the turbine to a shaft on which a brush is mounted. As the turbine rotates so does the brush.

The means for transmitting torque from the turbine to the shaft can include a system of reduction gears that provides a greater torque to the brush than is output by the turbine. The turbine may be located towards the front or the rear of the housing. When the turbine is located toward the rear, a backstop may be located adjacent the turbine so that water exiting the housing through the outlet is incident on the backstop. The backstop reverses the flow of water and includes slots or apertures that direct water towards the brush to increase the output of water directed to the user during soaping.

The brush may be driven by water from a shower supply. The brush may then form part of a shower head massager and include a reservoir housing soap for dispensation of soap with the water.

BRIEF DESCRIPTION OF THE DRAWINGS

For a more complete understanding of this invention, reference should now be made to the embodiment illustrated in greater detail in the accompanying drawings and described by way of example only. In the drawings.

DETAILED DESCRIPTION OF THE DRAWINGS

Figure 1:
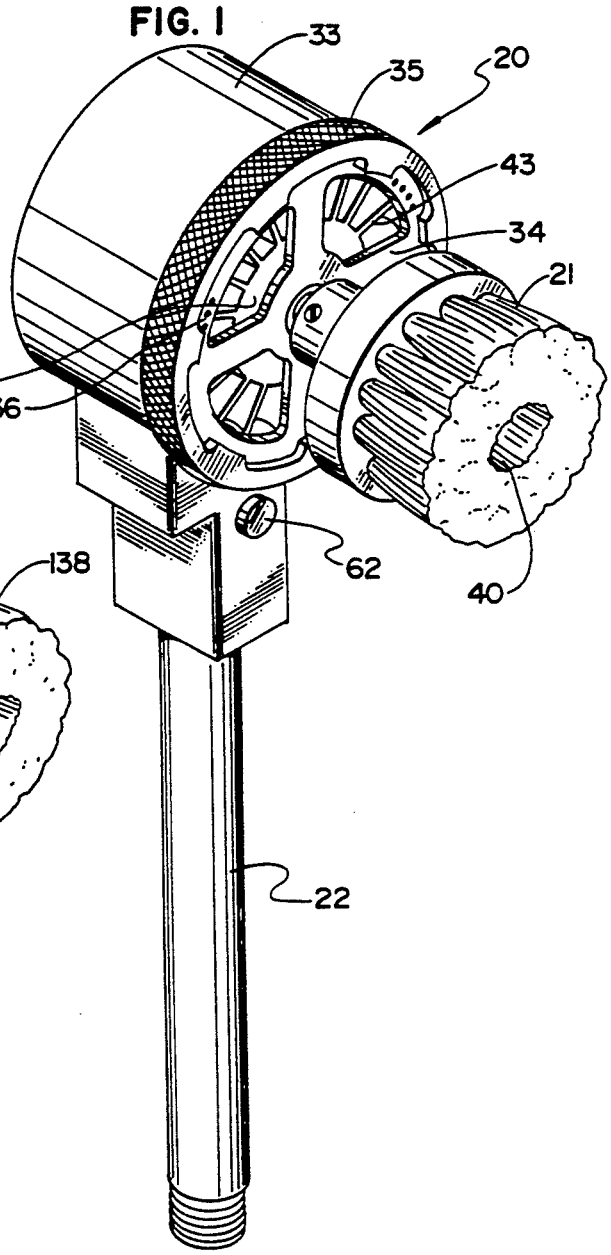
FIG. 1 is a perspective view of the shower head of one embodiment of the present invention.
Figure 7:
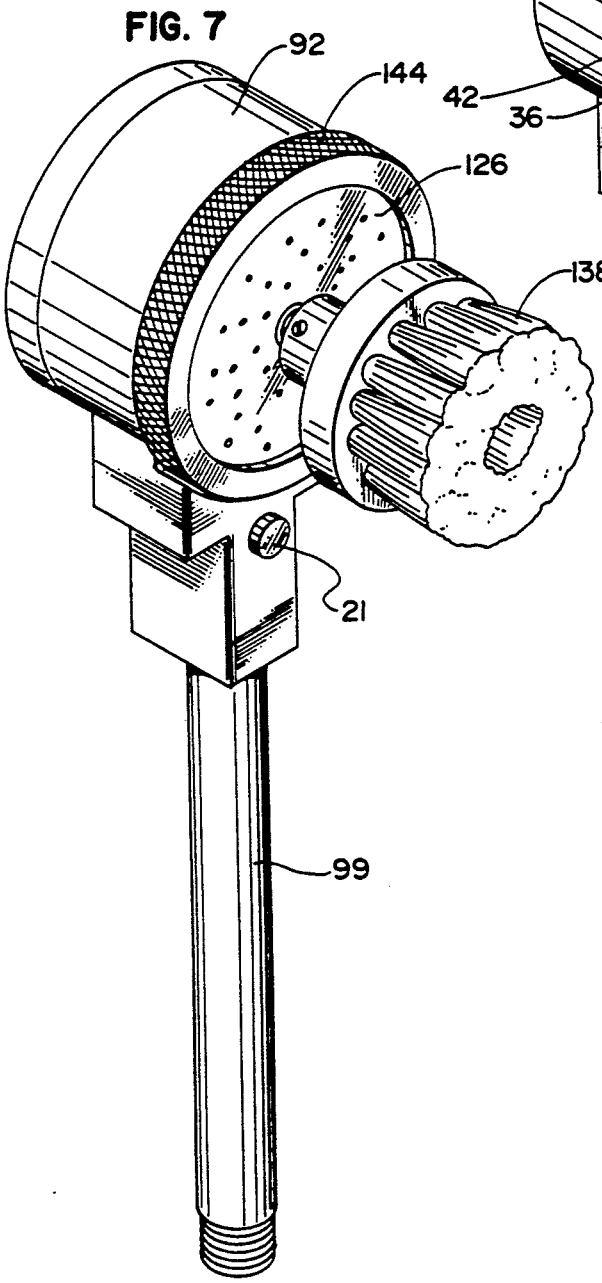
FIG. 7 is a perspective view of a shower head of a second embodiment of the present invention having a rear turbine and a backstop.

Turning to FIGS. 1–6 a turbine driven brush of the present invention for a shower head generally designated 20 can be seen. Located at the front is the output brush 21. The brush 21 rotates as water is fed in through the neck 22 to rotate a turbine 42 that drives the shaft 23 (seen most clearly in FIG. 3) to which the brush 21 is attached. The gearing system 46 present within a gear housing 24 serves to increase the output torque of the brush 21 to overcome the problems encountered with the low torque brushes presently available.

Figure 2:
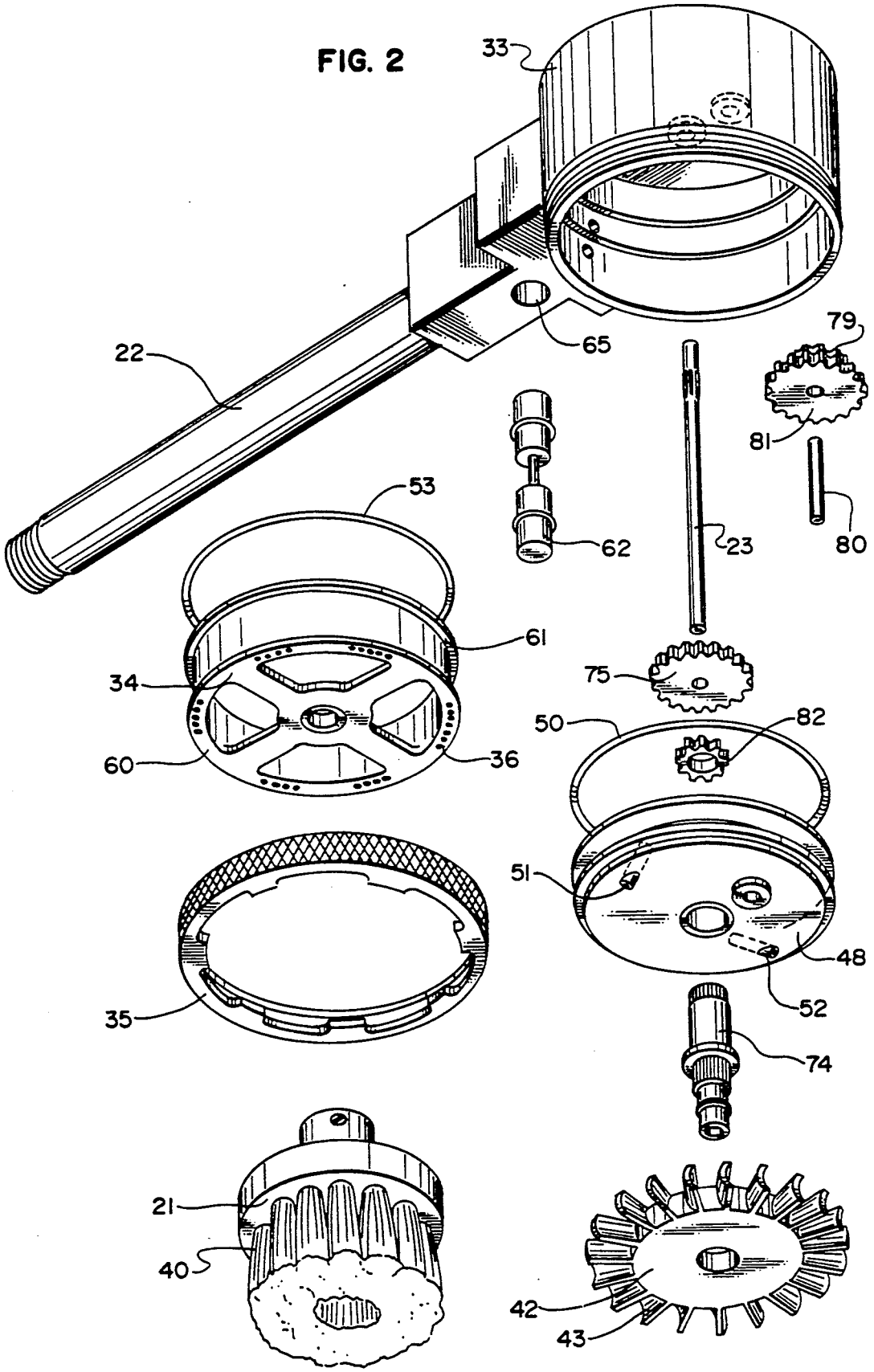
FIG. 2 is an exploded perspective view of the shower head of FIG. 1.

FIG. 2 is an exploded perspective of the shower head of FIG. 1 showing all the elements that permit the operation of the shower brush 20. The brush 21 is attached to the central output shaft 23 by a series of plastic connectors (seen most clearly in FIG. 3). A gripping section 25 holds the shaft 23 and has a groove 26. A threaded section 27 surrounds the gripping section 25 and a threaded neck of the brush 30 having an inward protrusion 31 fits over the gripping section 25 and the protrusion is guided along the groove 26. The threaded section 27 is tightened onto the threaded neck 30 of the brush 21 to secure it in position.

Located behind the brush 21 is the casing 33. In this embodiment the turbine 42 is located at the front of the casing 33 proximate the brush 21, the turbine 42 could however be located to the rear of the casing 33 as is the case in the alternative embodiment. The casing 33 contains all the moving parts for rotating brush 21. A spray cover 35 is attached by a screw thread to the front of the casing 33. This cover 35 serves to hold a spray front 34 in position and has a series of peripheral apertures 36 through which water is free to escape and wet the bristles 40 of the brush 21 and the targeted area.

Behind the spray front 34 is the turbine 42. The turbine has a series of turbine blades 43. The configuration of the blades 43 can be seen more clearly in FIG. 6. They are curved so that water impinging on the blades 4 is directed outwardly around the brush 21 rather than being carried around the turbine 42. There are two holes 44 and 45 that provide an entrance through which water from the neck 22 of the shower head 20 enters the outer casing 33. The first hole 44 provides entrance to a turbine storage chamber 49 defined by flanges 46 and 47 of the turbine chamber casing 48. Water enters this chamber and exits through angled orifices 51 and 52 to impinge on the blades 43 of the turbine 42. The orifices 51 and 52 are located at opposite sides of the chamber to increase the thrust supplied to the turbine 42. The turbine storage chamber 49 is sealed to prevent leakage of water into the gear housing 24 by an '0' ring 50 made of plastic or other waterproof flexible material.

To prevent leakage of water into other sections of the shower head 20 and thereby reduce losses due to reduced water flow at the turbine 42, a second ring 53 is placed between the turbine chamber 49 and the spray front 34. A third '0' ring 54 also prevents leakage from the turbine 42 into the water reservoir 55. This reservoir 55 is fed through hole 45 from the neck 22 of the shower head 20. The spray front 34 has two flanges 60 and 61 that define the reservoir 55. The front flange 60 includes the series of apertures 36 that serve to provide the spray from the shower head 20. The water that turns the turbine 42 exits through the cut away portions of the spray front 34 and wets the brush 21.

Figures 3, 4, 5, 6A, 6B:
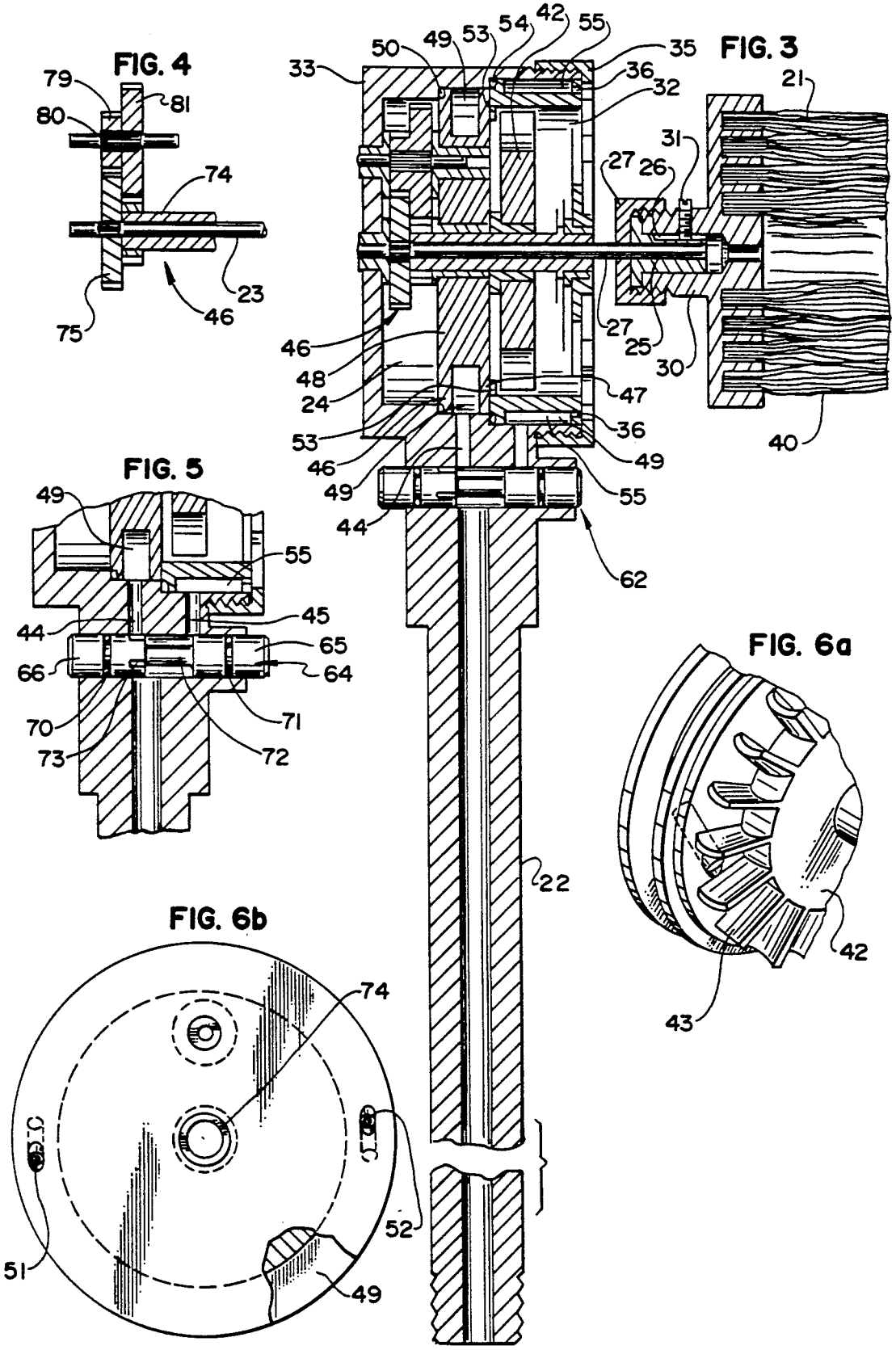
FIG. 3 is a longitudinal section through the shower head of FIG. 1.
FIG. 4 is a partial view of the shower head of FIG. 1 showing the detail of the gearing arrangement.
FIG. 5 is a partial section through the shower head of FIG. 1 showing the detail of the inlet valve.
FIG. 6*a* is a partial view of the shower head of FIG. 1 showing the configuration of the turbine blades.
FIG. 6*b* is a plan view of the chamber wall showing the positioning of the water inlets for impinging water onto the turbine blades.
Figure 8:
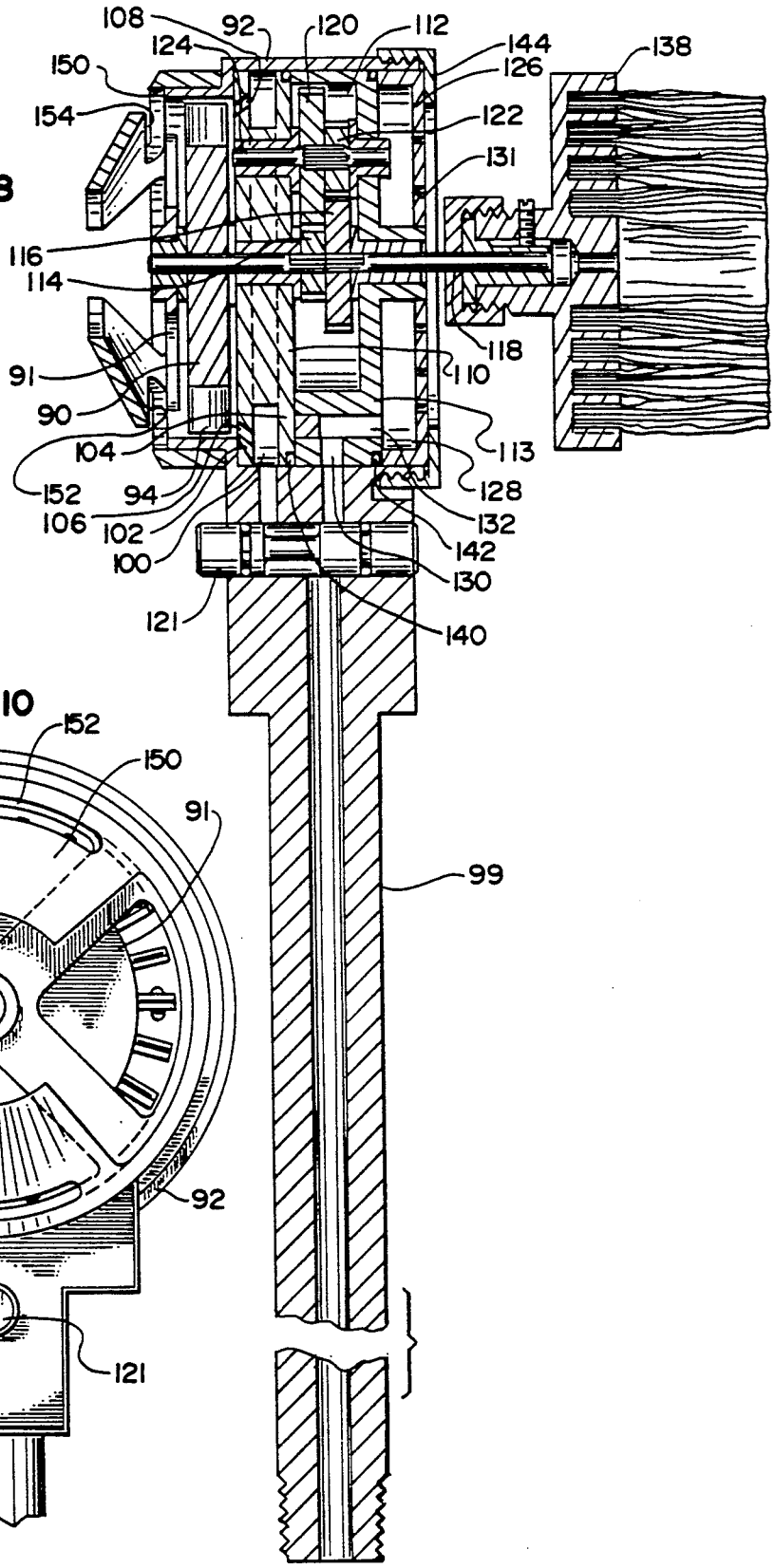
FIG. 8 is a section through the shower head of FIG. 7.
Figure 10:
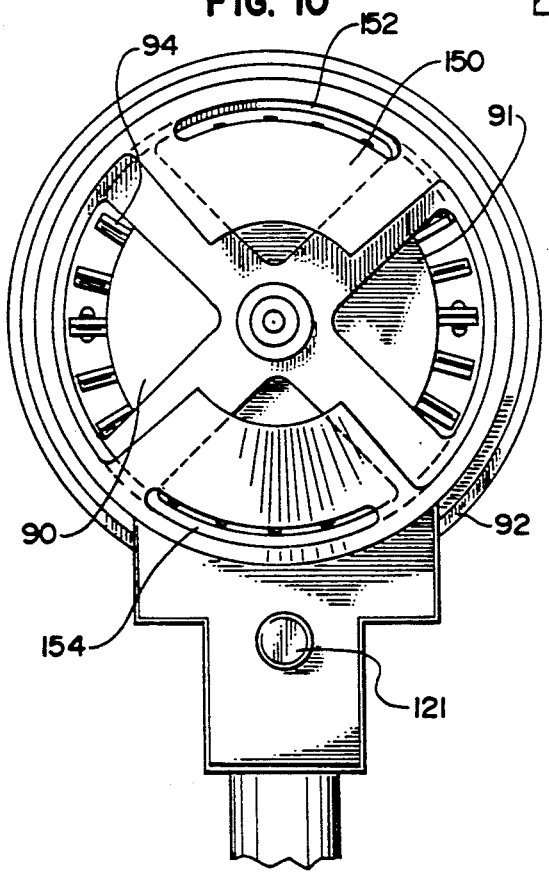
FIG. 10 is a rear view of the shower head of FIG. 7 showing the configuration of the backstop.
Figure 9:
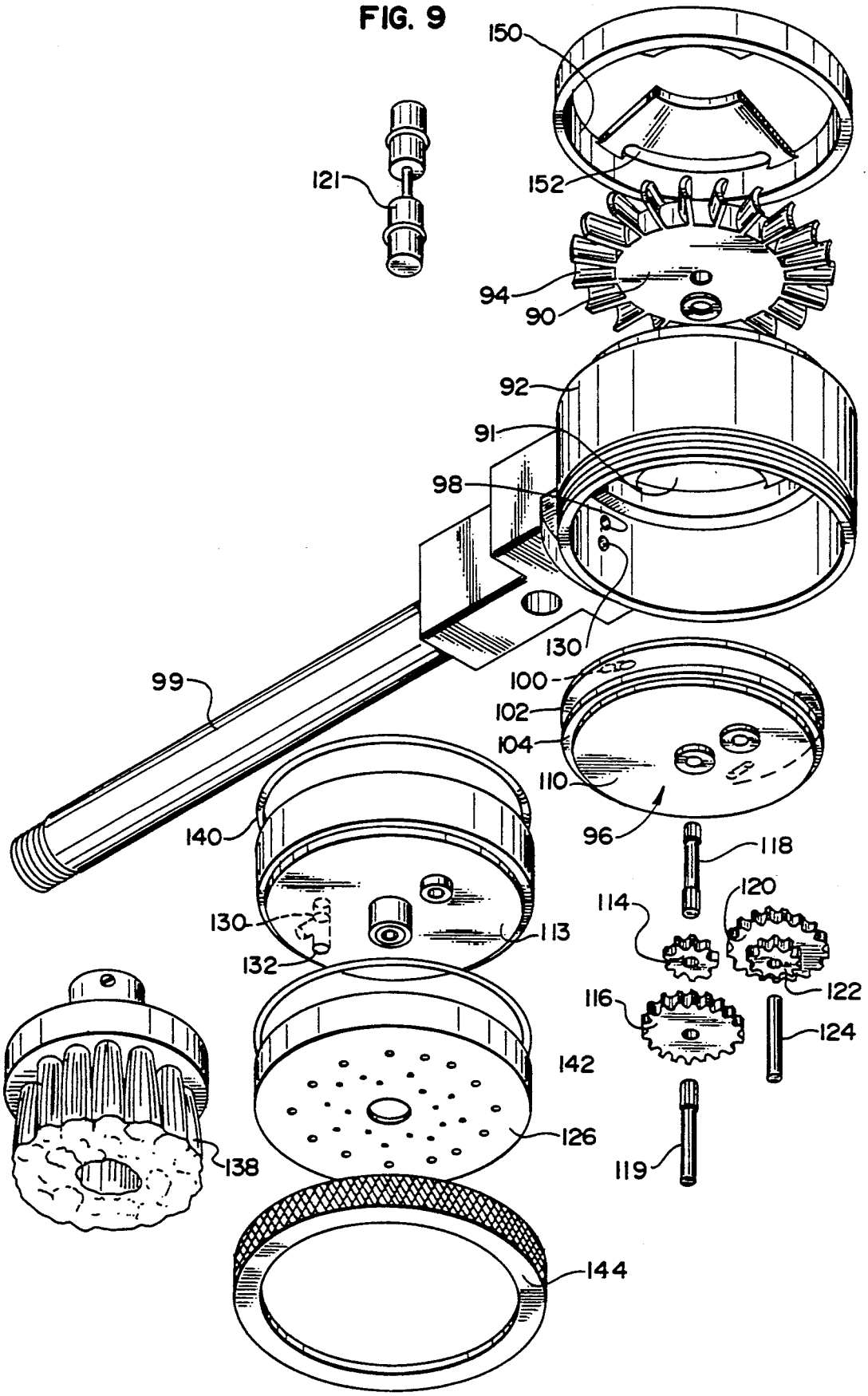
FIG. 9 is an exploded perspective of the shower head of FIG. 7.

A valve 62 operates to regulate the flow of water to the turbine chamber 49 and the reservoir 55. FIG. 5 shows the operation of the valve 62 in greater detail. Alternative positions for the valve can be seen in FIGS. 3 and 5. In FIG. 5, the valve provides water from the neck 22 to feed both the reservoir 55 and the turbine chamber 49. In the position of FIG. 3 water flows exclusively to the turbine 42 to provide greater torque for turning the brush 21.

As can be seen in FIG. 5, the valve 62 includes a hole 63 in which a valve stopper 64 is located. The stopper has three sections, first and second sections 65 and 66 respectively being of equivalent girth to that of the hole 63 and each having sealing '0' rings 70 and 71 to prevent water leakage, and a third thinner section 72 that allows water to flow from the shower neck 22 and pass into one of the holes 44 and 45 to the casing 33. The second section 66 has grooves 73 cut therein to enable water to be channelled to both the turbine chamber 49 and the reservoir 55 at the same time. This allows the user to provide water through the apertures 36 at the same time as rotating the brush head 21. The valve 62 may be positioned so that water is expelled solely through the apertures 36 from the reservoir 55 as shown in FIG. 3 or so that water is used solely for rotation of the turbine 42 and the brush 21 depending on the requirements of the user, water can be directed solely to the turbine 42 by rotating the valve by less than 90° so that the grooves 73 do not align with hole 44.

As the turbine 42 rotates so does the shaft 74 to which the turbine 42 is mounted. A reduction gearing system 46 that can be seen most clearly in FIG. 4 is located in the gear housing 24 and provides a high torque output to the shaft 74 that is fixed relative to the shaft 23 that drives the brush 21. The reduction gearing system 46 includes a gear wheel 75 fixed with respect to the turbine 42. This wheel 75 rotates within the gear housing 24 and is intermeshed with a first idler gear wheel 79 of smaller diameter rotating on an idler shaft 80. Rotating with first idler gear 79 on idler shaft 80 is a second idler gear 81 of diameter equivalent to that of the gear wheel 75. Second idler gear 81 is intermeshed with a gear wheel 82 of diameter equivalent to that of the first idler gear 79 that is fixed in relation to the brush shaft 23. This is one configuration of a reduction gear system that is utilized although others could be equally acceptable if the torque for rotating the brush 21 is increased to prevent the brush 21 stopping when force is applied to the surface to be cleared.

Turning now to FIGS. 7-10 an alternative embodiment of the invention with a rear turbine is shown. Many of the features function similar manner as those in the previous embodiment. The turbine 90 is located to the rear of the casing 92. The casing has open portions 91 at the rear to allow exit of water from the turbine. The turbine 90 with blade 94 operates in a similar way to that of turbine 42 of the previous embodiment. Because of the location of the turbine 90, the turbine chamber casing 96 is located forward of the turbine and aperture 98 in the casing 92 provides water flow from a neck 99 to the turbine chamber 100 defined by flanges 102 and 104 of the turbine chamber casing. Apertures 106 and 108 provide water to the turbine blades 94. The front face 110 of the turbine chamber casing 96 provides for a water tight gear chamber 112 along with a front piece 113. Gears 114 on shaft 118 and gear 116 on shaft 119 and idler gears 120 and 122, on idler shaft 124 provide a reduction gear system that operates in the same way as gear system 46 in the previous embodiment. The gears are reversed as the turbine is positioned at the rear rather than at the front.

The spray front 126 defines a spray chamber 128 into which water flows from neck 99 through aperture 130 in the casing 92 and 132 in the spray front 126. Water that enters the chamber 128 exits through the pattern of spray holes 134 in the front face 136 of the spray front. This provides a uniform coverage of water over and around the brush 138.

'0' rings 140 and 142 seal chambers 112 and 128 respectively in a similar manner to rings 50 and 54 of the previous embodiment. A cover 144 holds the spray front 126 and other parts in position. A valve stopper 121 operates in a manner similar to the valve stopper 64 of the previous embodiment to direct water from the neck 99 to either gear chamber 112 or spray chamber 128. The valve 121, however, has no grooves equivalent to grooves 73 of the previous stopper 64 to allow water to flow simultaneously into both chamber 112 and 128.

The shower head optionally includes a backstop 150. Water exiting the turbine 90 impinges on the backstop 150 breaking up the discharge of the flow of water outwardly away from the brush through apperatures 152 and 154 for achieving different spray patterns around the brush. This provides extra water flow outwardly away from the brush for achieving different spray patterns around the brush when the turbine alone is being driven i.e., when the valve 121 is positioned to allow flow through aperture 98 to the turbine chamber 100 and as a consequence no water exits through holes 134 in the spray front 126. Although one configuration of the backstop 150 is shown in this embodiment other alternatives may be utilized to provide different flow patterns for achieving different spray patterns around the brush. The backstop 150 is readily removable and can therefore be changed for one of a different configuration by the user to provide alternative operational characteristics of the shower head when desired.

The shower head of either of the previously described embodiments may include means for dispensing soap to the brush by the location of a soap chamber behind the brush. One possible configuration envisaged includes a soap chamber having a series of holes graduated in size that allow for the flow of soap and a rotatable cover that has one hole that can be placed in alignment with any one of the holes to provide for the required amount of soap for the desired application.

The two embodiments described above provide a brush that can be rotated at variable torque by the force of water flowing through a turbine. This enables brushes with relatively firm bristles to be utilized with the shower and also for a variable amount of pressure to be applied with the brush without stopping its operation. The back stop feature that can be included increases the torque achievable for a given flow of water. The addition of a soap dispenser also provides means by which the entire washing operation can be achieved solely with the use of the shower head.

While two preferred embodiments of this invention are illustrated, it will be understood, of course that the invention is not limited to these embodiments. Those skilled in the art to which the invention pertains may make modifications and other embodiments employing the principles of the invention, particularly upon considering the foregoing teachings.

What is claimed is:

1. A turbine driven rotating brush comprising:

a rotatable shaft;

a brush mounted on said shaft for rotation therewith;

a turbine having blades;

means for transmitting output torque from said turbine to said shaft;

a housing for enclosing said turbine and means for transmitting torque, having an inlet for receiving water flow, an outlet for discharging water flow, ports for directing water onto the blades of said turbine, a series of spray apertures located around said brush, and means for regulating the division of water between said turbine and said series of spray apertures.

2. The brush of claim 1 wherein said means for transmitting output torque comprises a reduction gear.

3. The brush of claim 2 wherein said reduction gear comprises:

an input member connecting said turbine to an input gear;

an output gear adapted for rotation of said rotatable shaft;

an idler shaft in parallel relation with said input shaft, having a first idler gear and a second idler gear mounted thereon, said first idler gear operatively connected to said input gear and said output gear operatively connected to said rotatable shaft.

4. The brush of claim 1 wherein said turbine blades are configured to receive input water from said ports for defection out of said housing.

5. The brush of claim 1 further comprising: backstop means for breaking up the discharge of the flow of water outwardly away from the brush.

6. The brush of claim 5 wherein said backstop means includes a pair of arcuate wings for breaking up the discharge of said water.

7. The invention of claim 1 wherein the means for regulating the division of water comprises a valve located within said inlet for directing the flow of water exclusively to said turbine or said series of spray apertures or to both said turbine and said series of spray apertures simultaneously.

8. A turbine driven rotating brush comprising:

a rotatable shaft;

a brush mounted on said shaft for rotation therewith;

a turbine having blades configured to receive input water from said ports for deflection out of said housing a reduction gear for transmitting output torque from said turbine to said shaft; and a housing for enclosing said turbine and reduction gear having an inlet for receiving water flow, an outlet for discharging water flow, a port for directing water onto the blades of said turbine, and a series of spray apertures, and a valve located in said inlet for regulating the division of water between said turbine and said series of spray apertures.

9. The brush of claim 8 wherein said reduction gear comprises:

an input member connecting said turbine to an input gear;

an output gear adapted for rotation of said rotatable shaft;

an idler shaft in parallel relation with said input shaft, having a first idler gear and a second idler gear mounted thereon, said first idler gear operatively connected to said input gear and said output gear operatively connected to said rotatable shaft.

10. A turbine driven rotating brush comprising a rotatable shaft;

a brush mounted on said shaft for rotation therewith;

a turbine having turbine blades configured to receive input water from said ports for deflection out of said housing;

reduction gear for transmitting output torque from said turbine to said shaft;

a housing for enclosing said turbine and said reduction gear having an inlet for receiving water flow; an outlet for discharging water flow, ports for directing water onto the blades of said turbine, backstop means for breaking up the discharge of the flow of water outwardly away from the brush, and a series of spray apertures; and a valve located within said inlet for regulating the division of water between said turbine and said series of spray apertures.

* * * * *